US007036595B2

(12) United States Patent
Hailey

(10) Patent No.: US 7,036,595 B2
(45) Date of Patent: May 2, 2006

(54) REMOVAL OF TUBULARS FROM WELLS

(76) Inventor: Charles D. Hailey, 11628 Burning Oaks, Oklahoma City, OK (US) 73150

( * ) Notice: Subject to any disclaimer, the term of this patent is extended or adjusted under 35 U.S.C. 154(b) by 0 days.

(21) Appl. No.: 10/246,965

(22) Filed: Sep. 19, 2002

(65) Prior Publication Data

US 2004/0123986 A1 Jul. 1, 2004

(51) Int. Cl.
*E21B 31/20* (2006.01)

(52) U.S. Cl. ..... 166/301; 166/98; 294/86.25; 294/96

(58) Field of Classification Search ..... 166/301, 166/98; 294/86.25, 96
See application file for complete search history.

(56) References Cited

U.S. PATENT DOCUMENTS

| | | | | | |
|---|---|---|---|---|---|
| 818,928 | A | * | 4/1906 | Walker | 294/86.14 |
| 1,460,099 | A | * | 6/1923 | Immel | 294/86.25 |
| 1,474,886 | A | * | 11/1923 | Boyce | 294/86.25 |
| 1,653,547 | A | * | 12/1927 | Cameron | 294/86.22 |
| 1,721,021 | A | * | 7/1929 | Hinderliter | 294/86.25 |
| 1,739,601 | A | | 12/1929 | Marble | |
| 1,762,621 | A | * | 6/1930 | Gray | 294/86.22 |
| 1,789,993 | A | | 1/1931 | Switzer | |
| 1,797,632 | A | * | 3/1931 | Brannon | 294/86.2 |
| 1,813,459 | A | * | 7/1931 | Miller | 294/86.21 |
| 1,882,650 | A | * | 10/1932 | Church | 294/86.2 |
| 1,996,068 | A | * | 4/1935 | Hinderliter | 294/86.21 |
| 2,705,998 | A | | 4/1955 | Spang | |
| 2,886,369 | A | | 5/1959 | Decuir | |
| 2,915,127 | A | | 12/1959 | Abendroth | |
| 2,984,302 | A | | 5/1961 | Church | |
| 3,727,692 | A | | 4/1973 | Kinley et al. | |
| 3,750,748 | A | | 8/1973 | Kinley et al. | |
| 5,074,355 | A | | 12/1991 | Lennon | |
| 5,078,546 | A | | 1/1992 | Fisk et al. | |
| 5,088,553 | A | | 2/1992 | Ralston et al. | |
| 5,197,773 | A | * | 3/1993 | Vick, Jr. | 294/86.18 |
| 5,306,101 | A | | 4/1994 | Rockower et al. | |
| 5,647,627 | A | * | 7/1997 | Baessler | 294/96 |
| 6,186,234 | B1 | | 2/2001 | Hailey | |
| 6,213,210 | B1 | | 4/2001 | Hailey | |

OTHER PUBLICATIONS

U.S. Appl. No. 09/669,182, filed Sep. 25, 2000, Charles D. Hailey.

* cited by examiner

*Primary Examiner*—David Bagnell
*Assistant Examiner*—G M Collins
(74) *Attorney, Agent, or Firm*—McAfee & Taft

(57) ABSTRACT

Slips slidably disposed on a mandrel for lowering into a well inside a tubular to be removed from the well move outwardly to engage the tubular upon withdrawing the mandrel carrying the slips from the well. In one implementation there is a conical surface such that movement between the slips and the conical surface expands the slips outwardly. These inner and outer bodies are relatively moved in the well such that the outer body expands against an inner surface of the tubular in the well preparatory to removing the tubular from the well. After removing the tool string and at least part of the tubular engaged by the slips out of the well, inner structure of the removal tool can be pulled, in a direction opposite to which the lifting force was applied, to disengage the slips from the removed portion of the tubular.

3 Claims, 4 Drawing Sheets

REMOVAL OF TUBULARS FROM WELLS

BACKGROUND OF THE INVENTION

This invention relates to removing a tubular from a well. Three specific applications are with plastic lining in metal casing cemented in a well, coiled tubing, and vent strings.

In constructing a well from which liquid or gas is to be produced, various types of tubing strings, referred to herein as "tubular" or "tubulars," can be put in the drilled borehole. One type is typically called "casing." Traditionally this has been a metal tubing having a relatively large inner diameter that allows other metal or plastic tubulars to be lowered through or into it. One way to use casing is to lower it into the borehole and then pump cement such that the cement is placed in the annulus between the casing and the wall of the borehole. These operations are performed using well-known techniques.

Another type of tubular that has been used is a smaller diameter string that is run into the well inside previously installed casing. Such a narrower string might be used to produce oil or gas from the well to the surface, for example. Another example is that such a string might be used to inject substances into the well, such as in a technique referred to as "secondary recovery" in which the injected substance pushes hydrocarbons out of the well (or out another well or other wells). Included in this category of tubulars are coiled tubing and vent strings. Although such tubulars are normally used in a manner that allows them to be run into or out of a well as desired, sometimes they are severed or dropped in the well whereby some other retrieval technique is needed to extract them from the well.

More recently, a different type of tubular has been used in some applications. This type of tubular includes plastic lining that is placed inside traditional metal tubing, for example. Such plastic lining is typically made of a thermoplastic polymer, a non-limiting example of which is polyurethane. With this type of tubular, some substances can be produced from or injected into a well without the use of the traditional inner production or injection tubing string referred to in the immediately preceding paragraph. The inner diameter of the lined casing is larger than the inner diameter of the traditional production or injection tubing; therefore, more production or injection per unit of time can be obtained through the lined casing alone than through the narrower traditional production or injection string. That is, higher volumetric flow rates can be obtained through the lined casing. This type of casing has been used, for example, in producing gaseous carbon dioxide from a first well and in injecting it into a second well in a secondary recovery process for driving liquid or gaseous hydrocarbons out of the second well or out of the formation intersected by the second well.

The lined casing application referred to above, in which no separate inner tubing string is used, has advantages over the traditional casing plus production/injection string technique. In addition to the larger flow advantage mentioned above, the lined casing can be used less expensively. Furthermore, the lining is more resistant to corrosion than the metal casing. Such lining can be used to cover damaged casing walls.

Although there are at least the aforementioned advantages, the plastic lining can be damaged during installation and sometimes the metal casing may corrode or deteriorate sufficiently that it needs to be repaired even though it may be covered by the lining. When this damage or deterioration occurs, the lining needs to be pulled out of the outer metal tubing and a new lining installed (and possibly repairs made to damaged metal tubing). Although the outer metal tubing is typically cemented into the well borehole, the lining is retained in the metal tubing by its own outwardly directed force and friction. That is, the lining is not glued or otherwise separately adhered to the metal tubing. Rather, the lining is inserted in known manner into the metal tubing in a radially inwardly compressed state; once installed, the resilient lining (having an uncompressed outer diameter larger than the inner diameter of the metal tubing) expands against the inner surface of the metal tubing so that the lining is held by the radially outward force exerted by the lining and friction between the outer surface of the lining and the inner surface of the tubing. At the mouth of the well, a plastic flange is fused to the upper end of the lining to also provide support.

In view of the foregoing, there is the need for a tool and method for removing tubulars from the well.

Although my prior inventions disclosed in U.S. Pat. Nos. 6,186,234 and 6,213,210 and in my U.S. patent application Ser. No. 09/669,182 are directed to satisfying the aforementioned needs, the following describes and claims a further invention having utility in removing tubulars from wells.

SUMMARY OF THE INVENTION

The present invention provides a tool for removing a tubular from a well. One definition of such a tool comprises slips slidably disposed for lowering into a well inside a tubular to be removed from the well such that the slips move outwardly to engage the tubular upon withdrawing the slips from the well.

Another definition of the tool of the present invention comprises: an inner engagement member to engage a tubular in a well from which the tubular is to be removed, the inner engagement member including a conical surface; and an outer engagement member disposed for relative longitudinal movement with the inner engagement member such that movement between an end of the outer engagement member and the conical surface occurs to expand the end of the outer engagement member outwardly in response to a lifting force applied to the inner engagement member.

Still another definition of a tool for removing a tubular from a well in accordance with the present invention comprises: a shaft having a first end to connect to a hoist for moving the tool into and out of a well, and the shaft having a second end; a slotted sleeve slidably mounted on the shaft; and a sleeve abutment body connected to the second end of the shaft such that an end of the slotted sleeve is movable along a surface of the sleeve abutment body.

A further definition of a tool of the present invention comprises: a collet shaft; a collet including collet fingers movably disposed on the collet shaft; and a spear connected to the collet shaft, the spear having a first tapered surface along which ends of the collet fingers move to displace the ends outwardly, and the spear having a second tapered surface to engage a tubular to be removed from the well. In a particular implementation, the ends of the collet fingers have grooved outer surfaces. The second tapered surface of the spear can be grooved. The spear can also include a removable tip having surfaces for receiving a wrench.

The present invention also provides a method of removing a tubular from a well. One definition of this comprises relatively moving inner and outer bodies disposed in a well such that the outer body expands against an inner surface of a plastic lining or coiled tubing or vent string tubular in the well preparatory to removing the tubular from the well. In a particular implementation, this relatively moving includes pulling on the inner body as part of a continuing pulling thereon to remove the tubular from the well.

Another definition of a method of removing a tubular from a well in accordance with the present invention comprises: engaging an inner surface of a tubular disposed in a well with a plurality of slips of a removal tool disposed in a tool string in the well; and moving the slips outwardly into tighter engagement with the tubular in response to applying a lifting force to the tool string. This method can further comprise: removing the tool string and at least part of the tubular engaged by the slips out of the well; and pulling on the removal tool, in a direction opposite to which the lifting force was applied, to disengage the slips from the removed portion of the tubular.

Still another definition of a method of removing a tubular from a well in accordance with the present invention comprises: lowering a removal tool into a well such that the removal tool engages an inner surface of a tubular in the well, wherein the removal tool includes a lower body and an upper body, the upper body having circumferentially disposed end segments and the upper body disposed relative to the lower body such that relative movement between the upper body and the lower body can occur; rotating the removal tool such that the removal tool penetrates farther into engagement with the tubular; applying a lifting force to the removal tool such that at least one of the lower body and the upper body moves longitudinally relative to the other and in response the circumferentially disposed end segments of the upper body move outwardly to be wedged against the tubular; and pulling the removal tool and least a portion of the tubular out of the well. This method can also further comprise removing a tip from an end of the lower body, connecting a pulling device to the lower body in place of the removed tip, and pulling on the pulling device to move the lower body in a direction relative to the upper body to release the upper body such that the circumferentially disposed end segments of the upper body are not wedged against the tubular.

Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 9 is an elevational view of an eye member and a pulling device connected thereto.

DETAILED DESCRIPTION OF THE INVENTION

U.S. Pat. Nos. 6,186,234 and 6,213,210 and U.S. patent application Ser. No. 09/669,182 are incorporated herein by reference.

Figure 1:
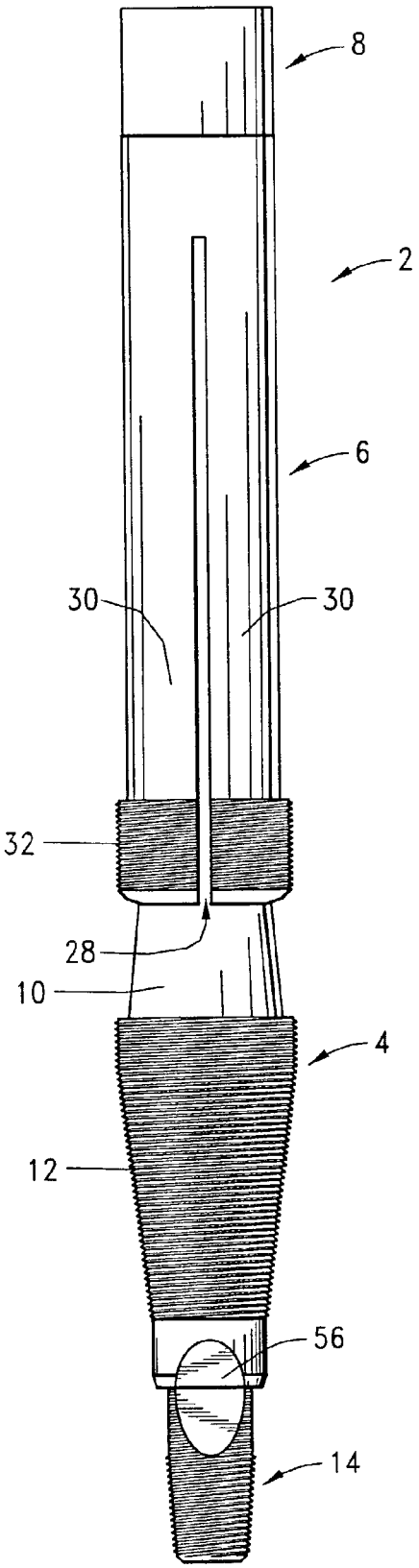
FIG. 1 is an elevational view of a removal tool, shown in a run-in position, of the present invention.
Figure 2:
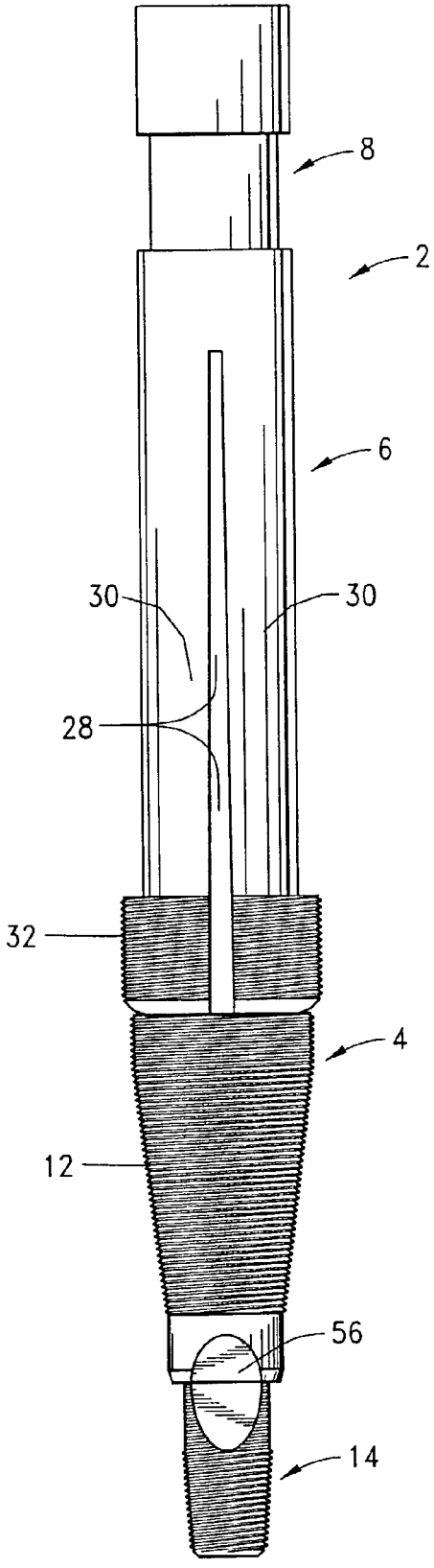
FIG. 2 is an elevational view of the removal tool shown in a tubular extraction position.

Referring to present FIGS. 1 and 2, one embodiment of a removal tool 2 of the present invention includes an inner engagement member 4 and an outer engagement member 6. The outer engagement member 6 is slidably disposed on a shaft 8 such that at least a portion of the outer engagement member 6 expands when the outer engagement member 6 slides on the shaft 8 to a respective position.

In a particular implementation illustrated in the drawings, the inner engagement member 4 has a conical surface 10. This surface 10 and the shaft 8 together define a mandrel for the outer engagement member 6, wherein the outer engagement member 6 of the depicted embodiment is of a type defining slips that move along the tapered, conical section 10 of this mandrel embodied in FIGS. 1 and 2. Movement for expanding the slips occurs upon withdrawing the slips from the well as will be more fully explained below. In general, the inner engagement member 4 and the outer engagement member 6 are disposed to move longitudinally relative to each other such that the conical surface 10 and an end of the outer engagement member 6 move relative to each other to expand the end outwardly. Such movement and expansion occur in the illustrated embodiment in response to a lifting force applied to the inner engagement member 4. FIG. 1 represents a run-in position of the removal tool 2 prior to such outwardly expanding movement, and FIG. 2 illustrates such outward position in which the outer engagement member 6 is in an extraction position preferably wedging the expanded portion of the outer engagement member 6 against an inner surface of the tubular to be removed from the well.

The inner engagement member 4 shown in FIGS. 1 and 2 has another tapered section, this one identified by the reference numeral 12. The surface of this section is grooved in the illustrated implementation.

The inner engagement member 4 further includes a tip 14 which is removable as will be further explained below.

Figure 3:
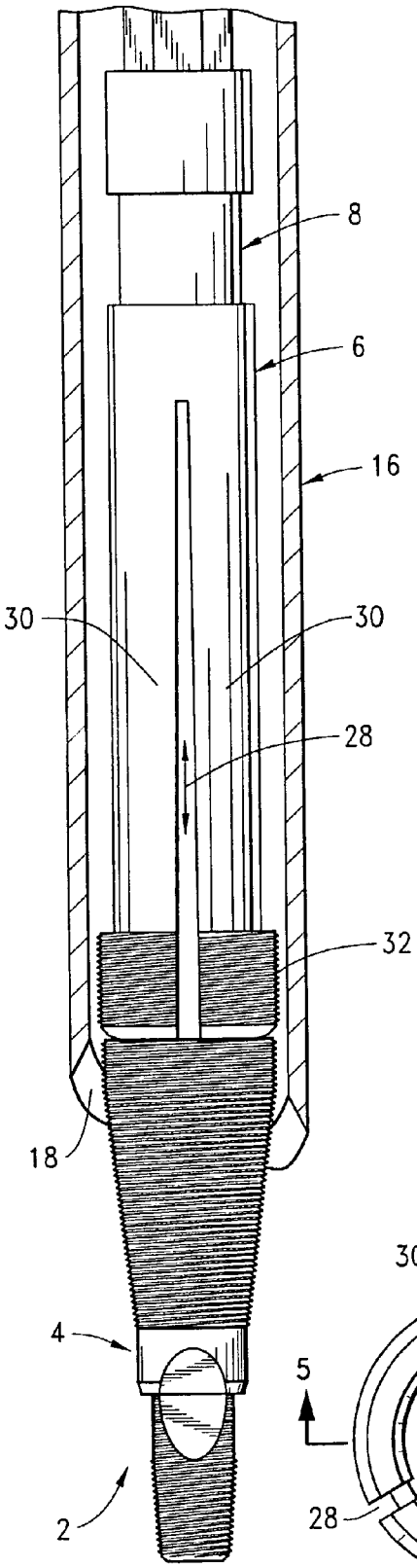
FIG. 3 is an elevational view of the removal tool shown in the position of FIG. 2 and an overshot skirt.

Referring to FIG. 3, an overshot skirt 16 has a lower cutting edge 18 that sits down on the upper presented edge of the tubular to be extracted when the overshot skirt 16 is run in the well with the removal tool 2. The tubular is made of suitable material known in the art, but typically is a plastic (for example, a thermoplastic polymer) or other composite capable of being engaged and extracted by the tool or method of the present invention. Examples include a plastic lining (such as inside casing, for example), composite coiled tubing, and vent strings. For example, a particular type of material used in the oil and gas industry for lining inside casing is polyurethane.

Figure 5:
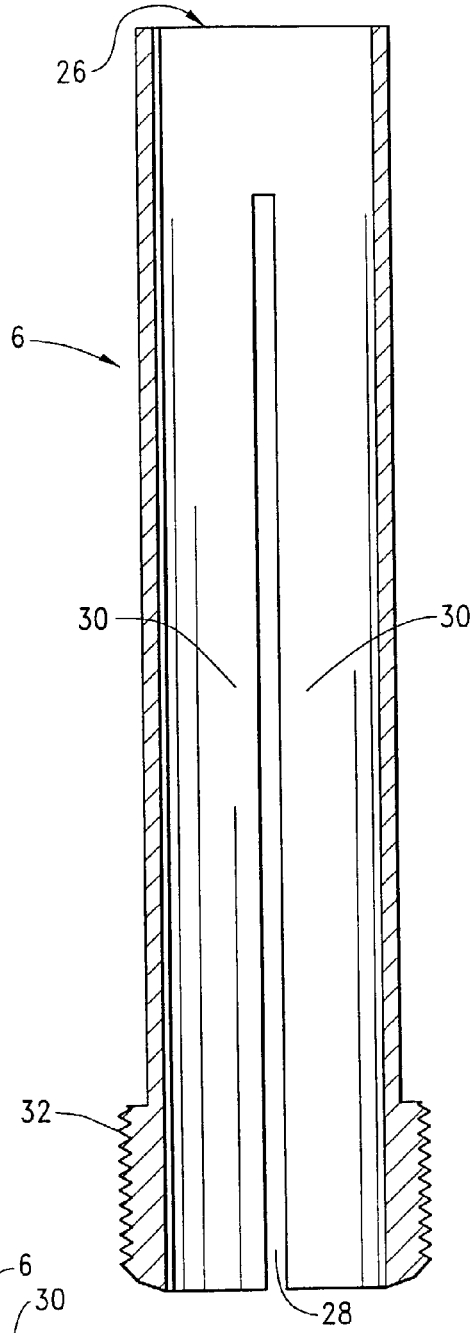
FIG. 5 is a sectional view of the outer engagement member of FIG. 4, as taken along line 5—5 in FIG. 4 and oriented as in a vertical well.
Figure 4:
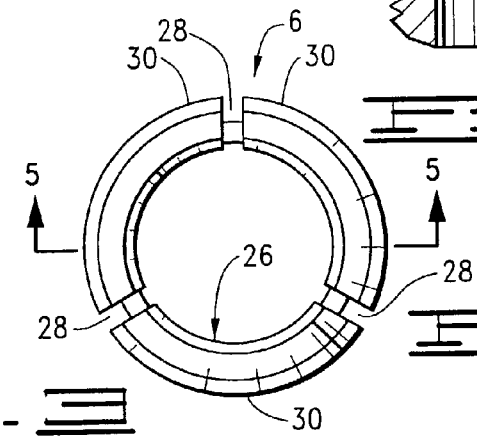
FIG. 4 is an end view of an outer engagement member of the removal tool of FIGS. 1–3.

Referring to FIGS. 4 and 5, as well as FIGS. 1–3, the outer engagement member 6 is defined in the illustrated implementation by a hollow cylindrical body 26. A plurality of longitudinal slits 28 are defined in the body 26 between longitudinal segments 30. Three slits 28 and three segments 30 are illustrated; however, two, or more than three, can also be used provided the utility of these portions for adequately engaging the tubular to be extracted is retained. Likewise, the nature and extent of the slits 28 and segments 30 can be varied so long as suitable deformability/expandability and structural integrity of the segments and overall member are maintained. This illustrated embodiment of the outer engagement member 6 defines a particular implementation of a slotted sleeve that slidably mounts on the shaft 8. This can be specifically referred to as a collet including collet fingers disposed on a collet shaft defined by the shaft 8.

As shown in FIG. 5, the ends of these "fingers" or segments 30 are thicker than the remainder of the wall of the sleeve of the outer engagement member 6. An outer diameter greater than the adjacent outer diameter of the inner engagement member 4 is defined across at least this part of the outer engagement member 6 when the inner engagement member 4 and the outer engagement member 6 of the removal tool 2 are in the relative position shown in FIGS. 2 and 3. This is the expanded, tubular engaging position of this illustrated removal tool. Also, this portion of the cylindrical body 26 has a grooved surface 32 to enhance gripping or engagement of the inner surface of the tubular that is to be removed from the well. In the relative position of FIG. 1, however, the outer diameter of this portion of the outer engagement member 6 having the grooved surface 32 is less than the aforementioned respective outer diameter of the inner engagement member 4; this facilitates run-in of the removal tool 2 into a well.

Figure 6:
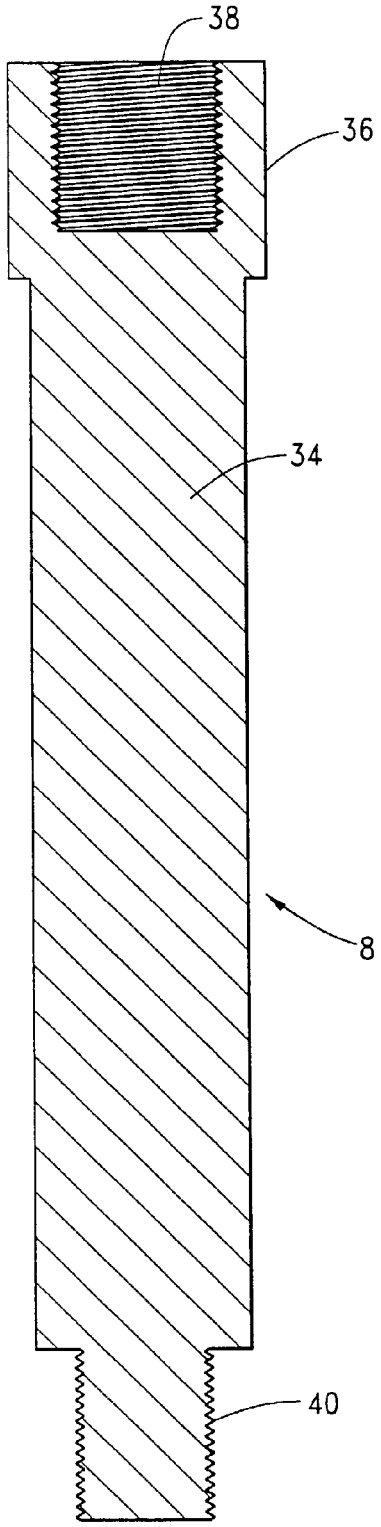
FIG. 6 is a sectional view of a shaft of the illustrated removal tool, on which shaft the outer engagement member is disposed in the removal tool of FIGS. 1–3.

Referring to FIG. 6, the shaft 8 of the illustrated implementation is defined by a solid cylindrical body 34 having one end to connect to a hoist for moving the tool 2 into and out of a well (this includes box end 36 having threaded cavity 38 for the implementation shown in FIG. 6) and having another end for connecting to the inner engagement member 4 (this is the end having threaded pin 40 for the implementation shown in FIG. 6). One example of a hoist includes a hex bar or kelly bar having a threaded pin end that screws into the threaded cavity 38.

Figure 7:
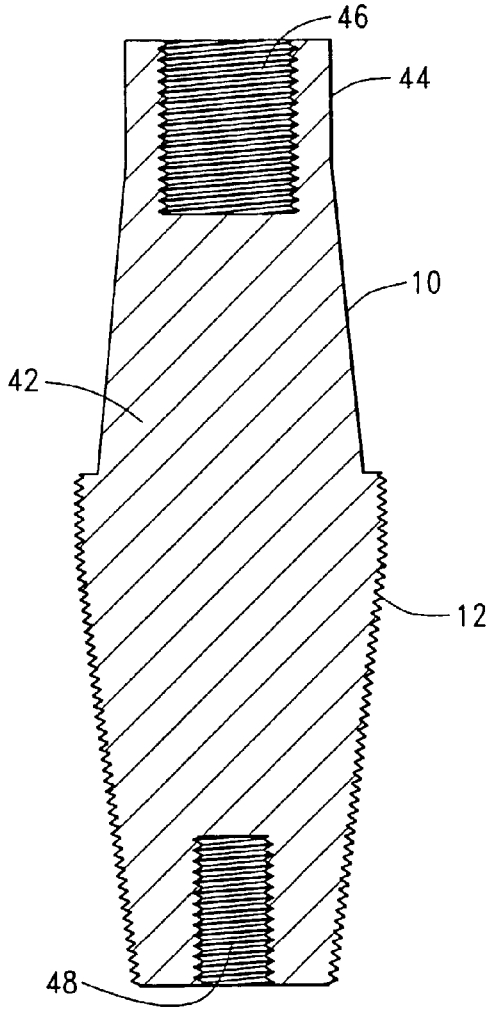
FIG. 7 is a sectional view of a main body of an inner engagement member of the removal tool of FIGS. 1–3.

Referring to FIG. 7, the inner engagement member 4 with its conical surface 10 defines a sleeve abutment body along which the lower (as oriented in the drawings) end of the slotted sleeve of the outer engagement member 6 is movable. In its particular implementation as the leading end of the removal tool 2 upon the tool's descent into the well, this inner engagement member 4 can also be referred to as a spear with its tapered surface 12 facilitating traversing down the well and its grooved configuration on surface 12 facilitating engagement with the inner surface of the tubular to be removed.

In the implementation of FIG. 7, the inner engagement member 4 is defined by a solid body 42 having a cylindrical neck portion 44 in which a threaded cavity 46 is defined to receive the threaded pin 40 of the shaft 8. The solid body 42 has the tapered portions including the upper conical surface 10 and the lower grooved portion 12. At the bottom (as oriented in FIG. 7 and for disposition in a well) of the tapered portion 12 is a threaded hole 48.

Figure 8:
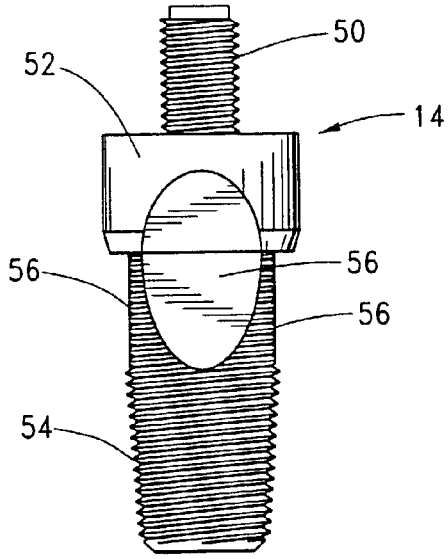
FIG. 8 is an elevational view of a removable tip for the main body of FIG. 7.
Figure 5:
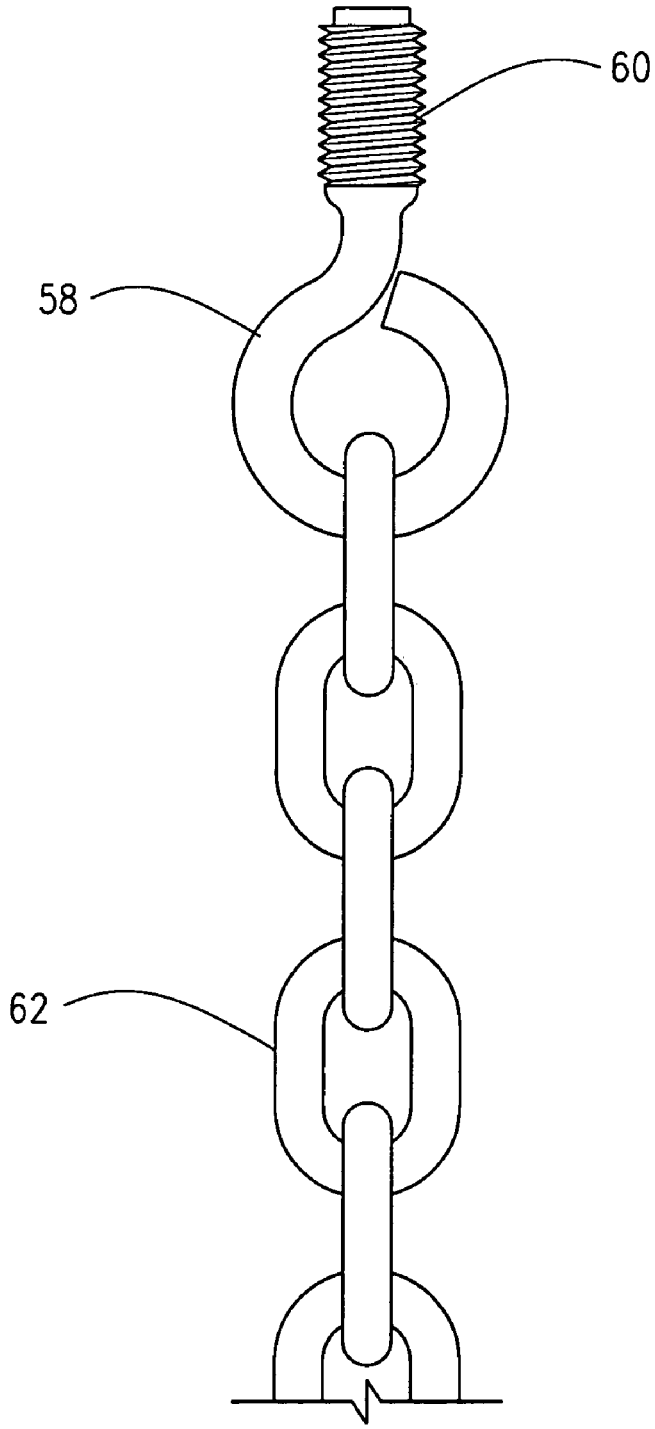

Referring to FIG. 8, the removable tip 14 of the illustrated implementation is defined by a solid body having a threaded pin 50 that is received in the threaded hole 48 shown in FIG. 7 to connect the tip 14 to the main body 42. This allows the tip 14 to be attached to or detached from the solid body 42. Below the threaded pin 50 is a collar 52 below which is defined a grooved nose portion 54. Flat surfaces 56 are defined on this body for receiving a wrench or other tool by which the tip 14 can be screwed into or unscrewed from the threaded hole 48 of the solid body 42 (three such surfaces are marked in FIG. 8 and a fourth one is opposite the one facing the viewer in FIG. 8; but other configurations can be used).

The components of the removal tool 2 can be made of any suitable material; non-limiting examples include steel of known type used in downhole tools in the oil and gas industry. These components can be formed in any suitable manner, including known metal machining techniques. Assembling the illustrated components is apparent from the drawings, namely, sliding the sleeve of FIGS. 4 and 5 and the shaft of FIG. 6 together and then screwing the pin 40 and the cavity 46 together; as mentioned above, the pin 50 of the tip 14 screws into hole 48.

The method of the present invention, which can be implemented for example using the removal tool 2 described above, includes engaging the tubular for applying a pulling force to the tubular so that it can be extracted from the well and applying a pulling force to lift the engaged tubular out of the well. Engaging the tubular includes, such as apparent from the above-described removal tool 2, relatively moving inner and outer bodies disposed in a well such that the outer body expands against an inner surface of a tubular (for example, plastic lining, composite coiled tubing, or vent string) in the well preparatory to removing the tubular from the well. Applying a pulling force can be implemented in any suitable manner, such as those presently known in the art for lifting tools out of a well (for example, using a derrick and a traveling block or other hoisting apparatus). In the particular illustrated implementation, this pulling is applied to the shaft 8 and the connected inner engagement member 4 as part of a continuing pulling thereon to remove the tubular from the well.

More specifically, the method of removing a tubular from a well in accordance with the present invention comprises: engaging an inner surface of a tubular disposed in a well with a plurality of slips of a removal tool disposed in a tool string in a well; and moving the slips outwardly into tighter engagement with the tubular in response to applying a lifting force to the tool string. For the illustrated embodiment, this includes lowering the removal tool 2 into the well such that an upper portion of the tubular abuts the overshot skirt 16, and preferably enters the gap between the removal tool 2 and the overshot skirt 16, of FIG. 3. A lifting force is applied, such as in a conventional hoisting manner from the surface, on the shaft 8 and connected inner engagement member 4. This pulls the tapered surface 10 up relative to the free sliding outer engagement member 6, thereby driving the enlarged portion thereof having grooved surface 32 outwardly from a position such as in FIG. 1 to a position such as in FIG. 2. This applies a secure holding force on the tubular trapped between the grooved surface 32 and the inside surface of the overshot skirt 16.

With regard to removing the tubular from the well, the method further comprises: removing the tool string and at least part of the tubular engaged by the slips out of the well; and pulling on the removal tool, in a direction opposite to which the lifting force was applied, to disengage the slips from the removed portion of the tubular. Pulling on the removal tool can, for example, include removing the removable tip 14 and in its place attaching an eye member to which a chain or other pulling device can be connected. When such device is then pulled, with the outer engagement member 6 being held against such pulling force, the conical surface 10 moves relatively away from the outer engagement member 6 so that the slip element ends thereof are released from their outwardly directed position (and thus move back toward a position as illustrated in FIG. 1 due to the resiliency of the material of the slip element ends).

This method can also include rotating the removal tool such that the removal tool penetrates farther into engagement with the tubular. This rotation typically twists the engaged tubular. To enhance any such twisting engagement, the method comprises applying the aforementioned lifting force to the removal tool such that at least one of the lower body and the upper body moves longitudinally relative to the other and in response the circumferentially disposed end segments of the upper body move outwardly to be wedged against the tubular. Then the removal tool and at least a portion of the tubular are pulled out of the well and separated such as described above.

Thus, the present invention can facilitate both coupling to the tubular downhole and decoupling from it at the surface after removal has occurred.

Other steps can be included in the method. Non-limiting examples include making a horizontal, circumferential cut around the tubular to sever one segment of it from another segment of the tubular. Another example is that a segment of the tubular to be removed can first be cut along a straight or a spiral path. This is particularly useful with plastic lining in helping to release it from the outer metallic tubing in which it is disposed. Examples of such cutting are described in my prior patents and application incorporated herein by reference.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of removing a first tubular from a second tubular disposed in a well, comprising:

lowering a removal tool into the well such that the removal tool engages an inner surface of the first tubular in the well, wherein the removal tool includes a lower body and an upper body, the upper body having circumferentially disposed end segments and the upper body disposed relative to the lower body such that relative movement between the upper body and the lower body can occur;

rotating the removal tool such that the removal tool penetrates farther into engagement with the first tubular;

positioning an overshot skirt in the well between the first and second tubulars;

locating the first tubular in a space defined between the overshot skirt and the upper body;

applying a lifting force to the removal tool such that at least one of the lower body and the upper body moves longitudinally relative to the other and in response the circumferentially disposed end segments of the upper body move outwardly to be wedged against the first tubular trapping the first tubular between the upper body and the overshot skirt;

pulling the removal tool and at least a portion of the first tubular out of the well; and connecting a pulling device to the lower body in place of the removed tip, and pulling on the pulling device to move the lower body in a direction relative to the upper body to release the upper body such that the circumferentially disposed end segments of the upper body are not wedged against the first tubular.

2. A method of removing a tubular from a well, comprising:

lowering a removal tool into the well such that the removal tool engages an inner surface of the tubular in the well, wherein the removal tool includes a lower body and an upper body, the upper body having circumferentially disposed end segments and the upper body disposed relative to the lower body such that relative movement between the upper body and the lower body can occur;

rotating the removal tool such that the removal tool penetrates farther into engagement with the tubular;

applying a lifting force to the removal tool such that at least one of the lower body and the upper body moves longitudinally relative to the other and in response the circumferentially disposed end segments of the upper body move outwardly to be wedged against the tubular;

pulling the removal tool and at least a portion of the tubular out of the well;

removing a tip from an end of the lower body; and connecting a pulling device to the lower body in place of the removed tip, and pulling on the pulling device to move the lower body in a direction relative to the upper body to release the upper body such that the circumferentially disposed end segments of the upper body are not wedged against the tubular.

3. A method of removing a tubular from a well, comprising:

lowering a removal tool into a well such that the removal tool engages an inner surface of a tubular in the well, wherein the removal tool includes a lower body and an upper body, the upper body having circumferentially disposed end segments and the upper body disposed relative to the lower body such that relative movement between the upper body and the lower body can occur;

rotating the removal tool such that the removal tool penetrates farther into engagement with the tubular;

positioning an overshot skirt in the well;

locating the tubular in a space defined between the overshot skirt and the upper body;

applying a lifting force to the removal tool such that at least one of the lower body and the upper body moves longitudinally relative to the other and in response the circumferentially disposed end segments of the upper body move outwardly to be wedged against the tubular;

pulling the removal tool and at least a portion of the tubular out of the well;

removing a tip from an end of the lower body;

connecting a pulling device to the lower body in place of the removed tip; and pulling on the pulling device to move the lower body in a direction relative to the upper body to release the upper body such that the circumferentially disposed end segments of the upper body are not wedged against the tubular.

* * * * *